US006931707B1

(12) United States Patent
Lathrop

(10) Patent No.: US 6,931,707 B1
(45) Date of Patent: Aug. 23, 2005

(54) ZIPPER ASSIST DEVICE

(76) Inventor: Richard A. Lathrop, 5444 S. Eastview Park, Chicago, IL (US) 60615

( * ) Notice: Subject to any disclaimer, the term of this patent is extended or adjusted under 35 U.S.C. 154(b) by 330 days.

(21) Appl. No.: 10/229,252

(22) Filed: Aug. 28, 2002

(51) Int. Cl.[7] ..... B29D 5/00; A41H 37/06

(52) U.S. Cl. ..... 29/410; 29/408; 29/766; 29/767; 29/768; 29/468; 29/281.1; 24/420; 24/430; 24/433; 24/434

(58) Field of Search ..... 29/408–410, 464, 29/468, 281.1, 33.2, 766, 767, 768–770; 24/420, 422, 385, 387–388, 430, 433, 434

(56) References Cited

U.S. PATENT DOCUMENTS

| | | | | | |
|---|---|---|---|---|---|
| 1,704,579 | A | | 3/1929 | Sanford | |
| 2,123,513 | A | | 7/1938 | Marinsky | |
| 2,395,677 | A | | 2/1946 | Marinsky | |
| 2,583,386 | A | * | 1/1952 | Moehler | 24/433 |
| 2,728,125 | A | * | 12/1955 | Wild | 24/388 |
| 2,974,382 | A | | 3/1961 | Carlile | |
| 3,004,318 | A | | 10/1961 | Weiser | |
| 3,775,812 | A | | 12/1973 | Carver, Jr. | |
| 4,078,279 | A | | 3/1978 | Heimberger | |
| 4,139,927 | A | | 2/1979 | Heimberger | |
| 4,221,026 | A | | 9/1980 | Kanzaka | |
| 4,326,319 | A | | 4/1982 | Friedberg | |
| 4,742,603 | A | | 5/1988 | Kazai | |
| 4,870,724 | A | | 10/1989 | Fujisaki et al. | |
| 5,007,145 | A | | 4/1991 | Kim | |
| 5,131,120 | A | | 7/1992 | Akashi | |
| 5,272,793 | A | | 12/1993 | Wilk | |
| 5,333,362 | A | | 8/1994 | Gillioz | |
| 5,412,849 | A | * | 5/1995 | Fudaki | 24/388 |
| 5,608,952 | A | | 3/1997 | Wilder | |
| 5,662,446 | A | * | 9/1997 | Haan | 411/514 |
| 5,791,023 | A | * | 8/1998 | Comerford | 24/386 |
| 6,088,888 | A | | 7/2000 | Oda | |
| 6,634,843 | B1 | * | 10/2003 | Tarnow et al. | 411/508 |

* cited by examiner

*Primary Examiner*—Eric Compton
(74) *Attorney, Agent, or Firm*—Seyfarth Shaw LLP

(57) ABSTRACT

A device is designed to facilitate operation of a separable slide fastener having a pair of stringers, respectively carrying first and second rows of interlocking elements, the rows respectively terminating at a stop member and a lug, the fastener including at least one slider moveable along the first row and having an aperture therethrough alignable with an aperture in the stop member when the slider is disposed in a terminal position. The device includes a handle and retention structure receivable in an aligning position in the apertures when the slider is in or is moved to its terminal position and engageable with the slider and the stop member to hold the slider in its terminal position so that the user does not have to manually do so during insertion of the lug into the apertures to join the stringers. When the lug is inserted it displaces the retention structure from the apertures. Several embodiments of the device are disclosed. They are usable with single-slider fasteners openable from one end or with dual slider fasteners openable from opposite ends.

20 Claims, 3 Drawing Sheets

ZIPPER ASSIST DEVICE

BACKGROUND

This application relates to the operation of separable slide fasteners, such as zippers, and relates in particular to techniques for facilitating the operation of such fasteners.

A separable zipper is used to join separable items, such as portions of a garment or other object. Such a zipper may be used on a jacket, sweater, vest or the like, and has two stringers, typically formed of a suitable fabric, and each carrying a row of interlocking elements, such as teeth. One row terminates at a stop member which has an aperture therein and, in one type of separable zipper, this aperture extends all the way through the stop member. The other row of interlocking elements terminates in a lug. A slider has a generally Y-shaped channel extending therethrough, the slider being captured on the first row of interlocking elements by receiving that row through one side of the Y-shaped channel.

To operate the zipper to a closed condition, the slider is moved to a terminal position against the stop member, wherein the stem of the Y-shaped channel aligns with the aperture in the stop member. Then the lug of the other stringer is inserted in the aperture formed by the other side of the Y-shaped channel in the slider and downwardly through the stem portion of the channel and into the aligned aperture of the stop member, pulling the other row of interlocking elements into the channel of the slider. Then, as the lug is held in the aperture of the stop member, the slider is moved upwardly away from the stop member, drawing the two rows of interlocking elements sequentially into interlocking engagement with each other, all in a well-known manner.

In some zippers, the stop member does not have an aperture therein. Instead, two sliders are provided, disposed in back-to-back arrangement on the one row of interlocking elements. To operate the zipper, the lower slider is moved to a terminal position against the stop member and the upper slider is moved against the lower slider. Then the lug of the other stringer is inserted in the apertures formed by the two sliders. When the upper slider is moved upwardly away from the lower slider, the two rows of interlocking elements are drawn into interlocking engagement with each other in the same manner as described above. However, in this case, the closed zipper can be opened from either end, by lowering the upper slider or raising the lower slider.

It is significant that, during insertion of the lug into the apertures, the slider must be held in its terminal position against the stop member or, in the two-slider zipper, the upper slider must be held against the lower slider while in its terminal position. This requires some manual dexterity and is often a difficult, and perhaps impossible, operation for persons with impaired dexterity, such as persons suffering from arthritis and the like. Efforts have heretofore been made to provide zipper arrangements which facilitate operation. However, such prior arrangements have all involved modifications to the zipper itself. Thus, in order to use such an arrangement, the user would have to purchase a garment or other object having such a modified zipper already installed thereon, or replace a standard zipper with the modified zipper design, which may be relatively expensive and inconvenient.

SUMMARY

This application discloses a technique for operating a separable slide fastener which avoids disadvantages of prior techniques while affording additional structural and operating advantages.

An aspect is the provision of a method and device for holding the slider of a separable slide fastener in a terminal position to facilitate fastening of the slide fastener.

A further aspect is the provision of a method and device of the type set forth for facilitating the operation of dual-slider slide fasteners.

Another aspect is the provision of a method and device of the type set forth which is of simple and economical construction.

Yet another aspect is the provision of the device of the type set forth which can easily be carried on or attached to the separable slide fastener or the object of which the fastener is a part.

Still another aspect is the provision of a technique of the type set forth which requires minimal manual dexterity.

Certain ones of these and other aspects may be attained by providing, a device for facilitating operation of a separable slide fastener having a pair of stringers respectively carrying first and second rows of interlocking elements, the first row terminating at a stop member having a first aperture therethrough, and a slider movable along the first row and having a second aperture therethrough and disposable in a terminal position against the stop member with the second aperture aligned with the first aperture, wherein the second row terminates in a lug receivable in the aligned apertures from the second aperture to the first aperture when the slider is in the terminal position to permit interlocking of the rows of elements by movement of the slider therealong, the device comprising: a device for facilitating operation of a separable slide fastener having a pair of stringers respectively carrying first and second rows of interlocking elements, the first row terminating at a stop member having a first aperture therethrough, and a slider movable along the first row and having a second aperture therethrough and disposable in a terminal position against the stop member with the second aperture aligned with the first aperture, wherein the second row terminates in a lug receivable in the aligned apertures from the second aperture to the first aperture when the slider is in the terminal position to permit interlocking of the rows of elements by movement of the slider there along, the device comprising: a handle adapted to be easily grasped by a user; and retention structure coupled to the handle and engageable with the slider and the stop member in a retaining position for holding the slider in its terminal position, the retention structure being displaceable from its retaining position during insertion of the lug into the aligned second and first apertures.

BRIEF DESCRIPTION OF THE DRAWINGS

For the purpose of facilitating an understanding of the subject matter sought to be protected, there are illustrated in the accompanying drawings embodiments thereof, from an inspection of which, when considered in connection with the following description, the subject matter sought to be protected, its construction and operation, and many of its advantages should be readily understood and appreciated.

DETAILED DESCRIPTION

Figure 3:
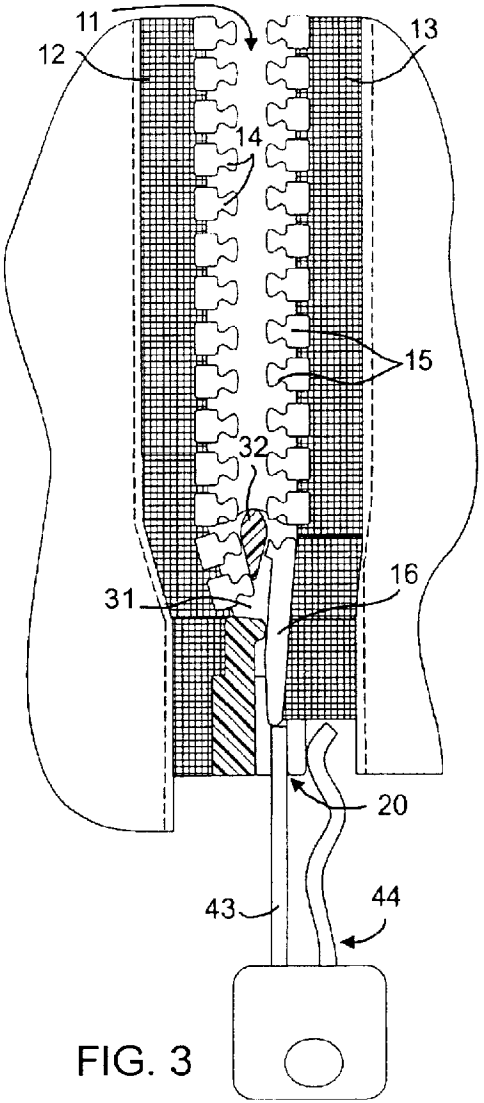
FIG. 3 is a view similar to FIG. 2, illustrating insertion of the zipper lug.

Referring to FIGS. 1–4, there is illustrated an object 10, which may be in the nature of a garment, such as a jacket or the like, incorporating a slide fastener 11 in the nature of a zipper of known construction. The zipper includes two stringers 12 and 13, which may be formed of a suitable fabric, and are respectively fixedly secured by suitable means to the portions of the object 10 to be joined by the slide fastener 11. The stringers 12 and 13 respectively carry rows of interlocking elements or teeth 14 and 15, the row of teeth 15 terminating in an elongated lug 16. The row of teeth 14 terminates in a stop member 20, which has an elongated base portion 21 integral with the stringer 12 and a socket portion 22 which projects laterally from the base portion 21. The socket portion 22 includes a pair of parallel, rectangular legs 23 and 23*a* (see FIGS. 1 and 4) respectively provided at their distal ends with flanges 24 (one shown) which project toward each other. The legs 23, 23*a* cooperate to define therebetween an aperture 25 which extends longitudinally through the stop member 20, the flanges 24 being spaced apart by a narrow gap which defines a slot 26 communicating with the aperture 25.

The slide fastener 11 also includes slider 30, which includes a pair of plates 31 (see FIGS. 1 and 4) joined at one end thereof by a bridge 32. Each plate 31 is provided along opposite side edges thereof with a flange 33 (one shown) projecting toward the opposite plate, the flanges 33 on a side being spaced apart to define a narrow slot 34 therebetween (see FIG. 2). Thus, the plates 31, the bridge 32 and the flanges 33 cooperate to define in the slider 30 a generally Y-shaped channel 35 having a pair of arm portions 36 and 37 which converge to form a stem portion 38 (see FIG. 1). The slider 30 is trapped on the row of teeth 14, which are received through one side of the Y-shaped channel 35, the stringer 12 being accommodated in the slot 34 between the flanges 33, so that the slider 30 is freely slidably moveable along the row of teeth 14, all in a known manner. The slider 30 has a lug 39 which pivotally carries a pull tab 39*a*. The rows of teeth 13 and 14, the lug 16, the stop member 20 and the slider 30 may all be formed of metal or a suitable plastic or composite material.

Figure 2:
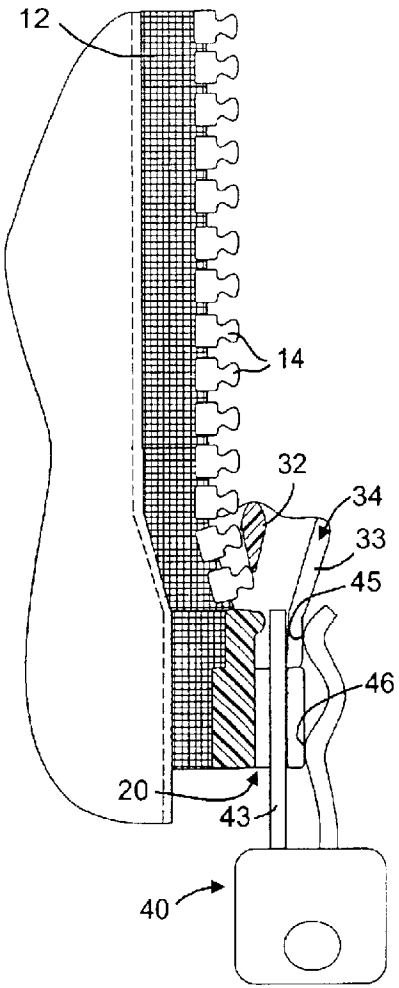
FIG. 2 is a view similar to FIG. 1, illustrating the slider in its terminal position and the facilitating device in engagement with the slider.
Figure 1:
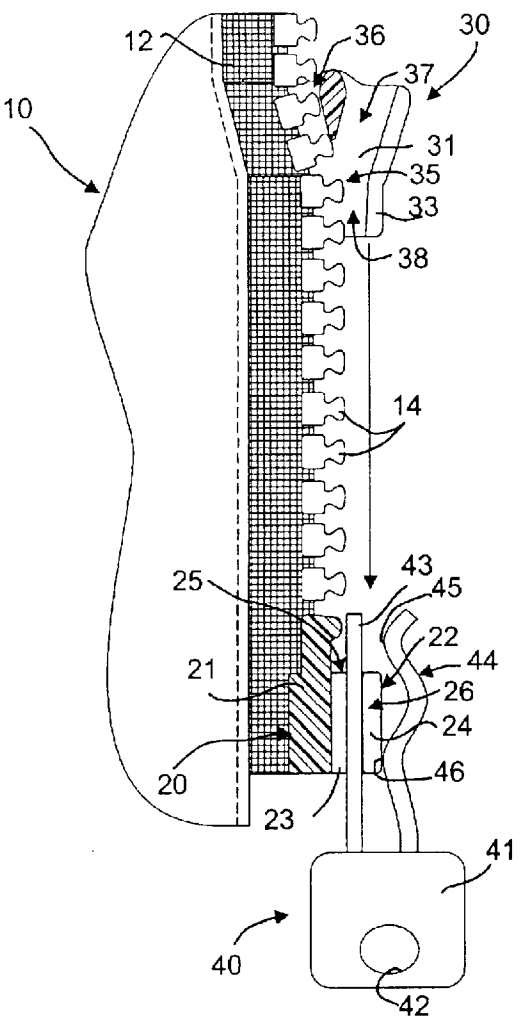
FIG. 1 is a fragmentary front elevational view of a portion of a separable zipper illustrating use of a facilitating device in accordance with a first embodiment shown engaged with a stop member of the zipper.
Figures 4, 5, 6, 7, 8, 9:
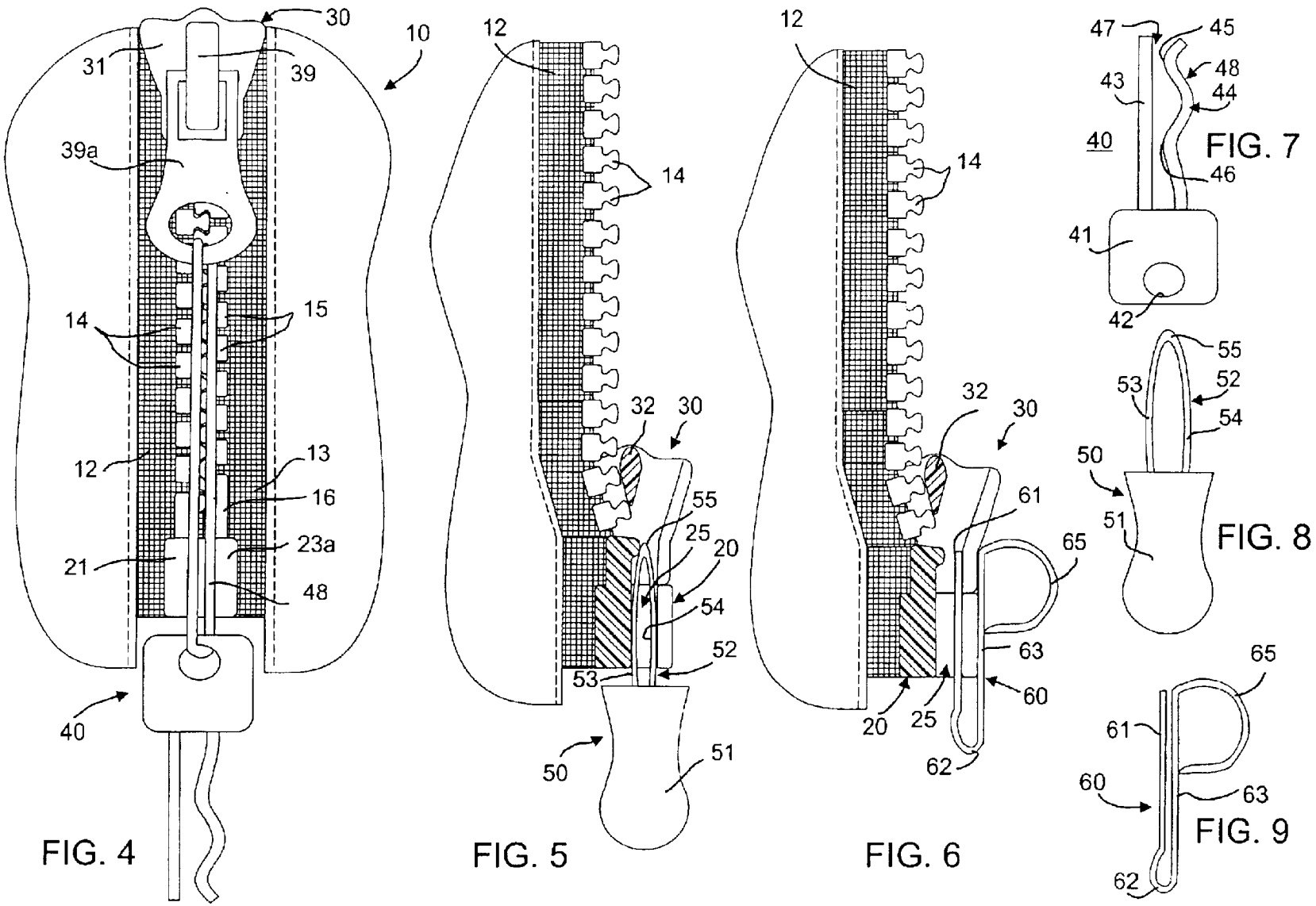
FIG. 4 is a view similar to FIG. 3, showing the fastened zipper and illustrating attachment of the facilitating device to the slider.
FIG. 5 is a view similar to FIG. 2, illustrating another embodiment of the facilitating device.
FIG. 6 is a view similar to FIG. 5, illustrating yet another embodiment of facilitating device.
FIG. 7 is a front elevational view of the facilitating device of FIG. 1 in its normal rest position.
FIG. 8 is a front elevational view of the facilitating device of FIG. 5 in its normal rest position.
FIG. 9 is a front elevational view of the facilitating device of FIG. 6, in it is normal rest position.

In normal operation, in order to close the slide fastener 11, the slider 30 is first slid down to a terminal position against the socket portion 22 of the stop member 20, with the upper end of the base portion 21 of the stop member 20 being received in the stem portion 38 of the Y-shaped channel 35, as shown in FIG. 2. The slider 30 must then be manually held in this terminal position while the lug 16 is inserted downwardly through the arm portion 37 and stem portion 38 of the Y-shaped channel 35, and then sent to the aperture 25 in the socket portion 22 of the stop member 20, the stringer 13 being accommodated in the slot 34 of the slider 30 and the slot 26 of the stop member 20. The slider 30 may then be slid upwardly away from the stop member 20, drawing the rows of teeth 14 and 15 sequentially into interlocking engagement with each other, as seen in FIG. 4, all in a known manner. As was indicated above, this process, and particularly manually holding the slider 30 against the stop member 20, requires a degree of manual dexterity which may be difficult or nearly impossible for certain persons, such as those suffering from arthritis or the like.

Referring also to FIG. 7, in order to alleviate this situation, there is provided a facilitating device, generally designated by the numeral 40, which includes a base or handle 41, which may be of any desired size and shape and may be formed of any suitable relatively rigid material. The handle 41 may have an opening 42 formed therethrough. Integral with the handle 41 and projecting from one side thereof is a retention structure 48, which includes a post 43, which may be substantially cylindrical in the shape and may be formed of any suitable, relatively rigid material. The post 43 is dimensioned to be freely receivable in the aperture 25 of the stop member 20 and in the stem portion 38 and arm portion 37 of the Y-shaped channel 35 of the slider 30. The retention structure 48 also includes a grip arm 44, which is integral with the handle 41 and projects therefrom generally alongside the post 43. The grip arm 44 may be undulating in shape, having plural longitudinally spaced-apart peaks or crests, two of which, 45 and 46, are illustrated. Preferably, in the at-rest condition of the facilitating device 40, the crests 45 and 46 of the grip arm 44 are spaced from the post 43 a distance slightly less than the thickness of the flanges 24 and 33 of the stop member 20 and slider 30. The post 43 and the grip arm 44 may be formed of the same or different materials, but both are relatively rigid and, at least the grip arm 44 is somewhat flexible and resilient, so that it may be resiliently flexed from its at-rest condition toward and away from the post 43. The post 43 and the grip arm 44 may be formed of a suitable metal, such as a spring steel or the like. The distal end of the grip arm 44 may diverge from the post 43 to form a relatively wide entry opening 47 (see FIG. 7). Each of the grip arm 44 and post 43 may be slightly thicker than the width of either of the slots 26 and 34 to prevent passage therethrough.

In operation, the distal end of the post 43 is inserted upwardly through the aperture 25 in the stop member 20, either before or after the slider 30 has been moved to its terminal position. The grip arm 44 will be flexed slightly away from the post 43 during this operation to permit passage of the flange 24 therebetween, this passage being facilitated by the wide entry opening 47. Insertion continues until the distal end of the post 43 is disposed well within the Y-shaped channel 35 of the slider 30 (see FIG. 2). During this insertion, the post 43 and the grip arm 44 cooperate to frictionally grip therebetween a flange 33 of the slider 30 and a flange 24 of the stop member 20, thereby frictionally holding the facilitating device 40 in place thereon and also frictionally holding the slider 30 in its terminal position against the stop member 20, as seen in FIG. 2.

The facilitating device 40 may then either be released or the user may continue to hold it while the lug 16 is inserted downwardly through the aperture defined by the right-hand side of the Y-shaped channel 35 in the slider 30 and into the aperture 25 of the stop member 20, as viewed in FIG. 3. While the user may choose to continue grasping the handle 41 of the device 40 during this operation, that will be much easier than it is to manually hold the slider 30 and the stop member 20 together. Alternatively, the user can simply release the device 40 and grasp an adjacent edge of the garment or the other object 10. As the lug 16 passes through the Y-shaped channel 35 and the aperture 25, it engages the distal end of the post 43 and displaces the post 43 from the apertures. If desired, the device 40 may be attached to the slider 30, as by suitable cord 48, or the like, extending between the opening 42 in the device 40 and a corresponding opening in the pull tab 39*a* of the slider 30, as shown in FIG. 4. This way the device 40 will not become detached when it is completely displaced from the stop member 20.

After the lug 16 has been fully inserted in the slider 30 and stop member 20, the slider 30 may be pulled upwardly to close the slide fastener 11 in the usual manner.

Referring now to FIGS. 5 and 8, there is illustrated an alternative facilitating device, generally designated by the numeral 50, which has an enlarged base or handle 51, which, in the illustrated embodiment, is generally knob-shaped, but may have any desired size and shape. Secured to the handle 51 is one end of a retention structure in the form of an elongated arch or hoop 52 which has a pair of legs 53 and 54 joined by a bight 55. The arch 52 may be formed of any suitable flexible and resilient material, such as a suitable metal, plastic or composite. In the at-rest condition of the arch 52, the legs 53 and 54 are spaced apart a distance greater than the distance between the base portion 21 and the flanges 24 of the stop member 20, the arch 52 being relatively long and narrow so that the bight 55 is relatively pointed.

In operation, the bight 55 of the arch 52 is inserted upwardly through the aperture 25 in the stop member 20 and into the stem portion 38 of the Y-shaped channel 35 in the slider 30 in its terminal position, as illustrated in FIG. 5. The arch 52 has a length such that it can be inserted well up into the Y-shaped channel 35, the legs 53 and 54 being flexed together toward each other during this insertion operation, but the normal outward bias of the legs 53 and 54 holding them firmly in frictional engagement with the adjacent surfaces of the base portion 21 and flange 24 of the stop member 20 and the flange 33 of the slider 30. Thus, the device 50 is retained in place in the apertures 25 and 35 and also serves to hold the slider 30 in its terminal position.

Thereafter, operation of the zipper 11 proceeds in the same manner as was described above in connection with FIGS. 1–4, the insertion of the lug 16 into the apertures 35 and 25 serving to displace the arch 52 therefrom. It will be appreciated that, if desired, the handle 51 could also be attached to the pull tab 39*a* of the slider 30 or to any other desired portion of the object 10 to retain the device 50 after its displacement from the stop member 20.

Referring now to FIGS. 6 and 8, there is illustrated another embodiment of facilitating device, generally designated by the numeral 60, which is of unitary one-piece construction and may be formed of any suitable relatively rigid but flexible and resilient material, such as suitable plastic or composite, or a metal, such as spring steel. The device 60 includes an elongated post 61, which may be similar in size and shape to the post 43 of the device 40, described above, and which is joined at one end thereof by a generally U-shaped bight 62 to an elongated grip arm 63, which is substantially parallel to the post 61 and is spaced there from a distance slightly less than the thickness of the flanges 24 and 33 of the stop member 20 and slider 30. The post 61 and the grip arm 63 cooperate to form a retention structure. Integral with the distal end of the grip arm 63 and extending laterally outwardly and downwardly therefrom and back to the outer surface of the grip arm 63 is an enlarged handle loop 65, which may have any desired size and shape.

The operation of the facilitating device 60 is substantially similar to that of a device 40, described above, the post 61 being inserted into the apertures 25 and 35 from therebelow and the post 61 and grip arm 63 cooperating to frictionally grip therebetween the flanges 24 and 33 of the stop member 20 and a slider 30, as is illustrated in FIG. 6. Of course, the device 60 may be attached by suitable means to the slider pull tab 39*a* or other portion of the object 10, as described above.

Figure 12:
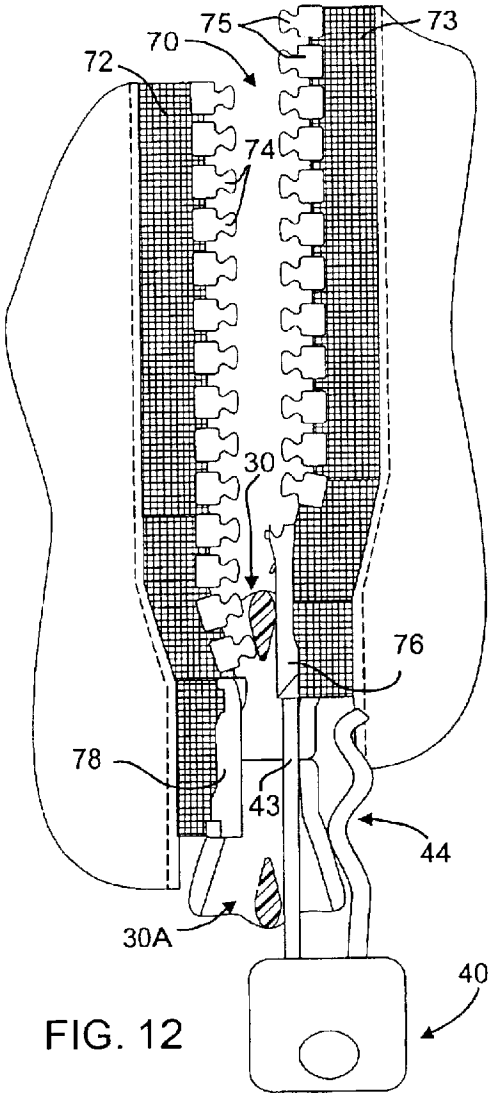
FIG. 12 is a view similar to FIG. 3, illustrating operation of the device with a dual-slider zipper.
Figure 11:
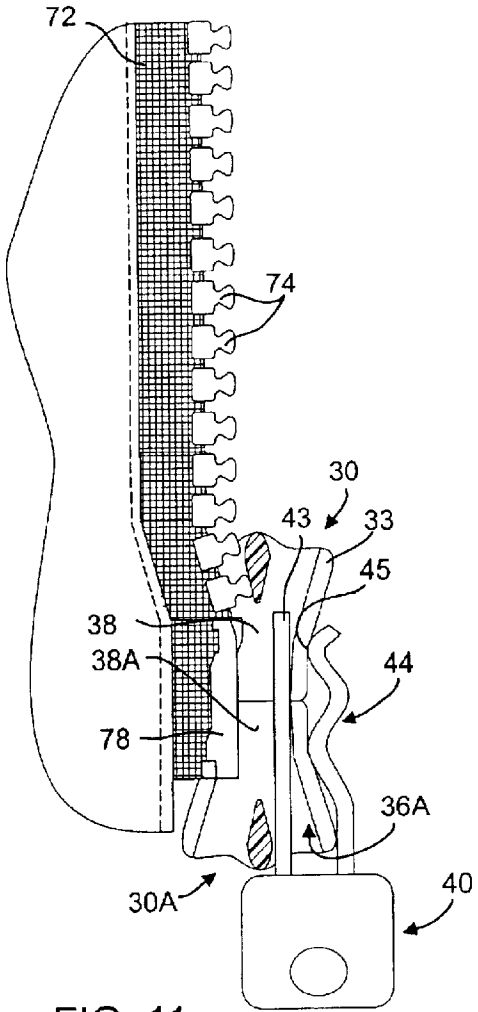
FIG. 11 is a view similar to FIG. 2, illustrating operation of the device with a dual-slider zipper.
Figure 10:
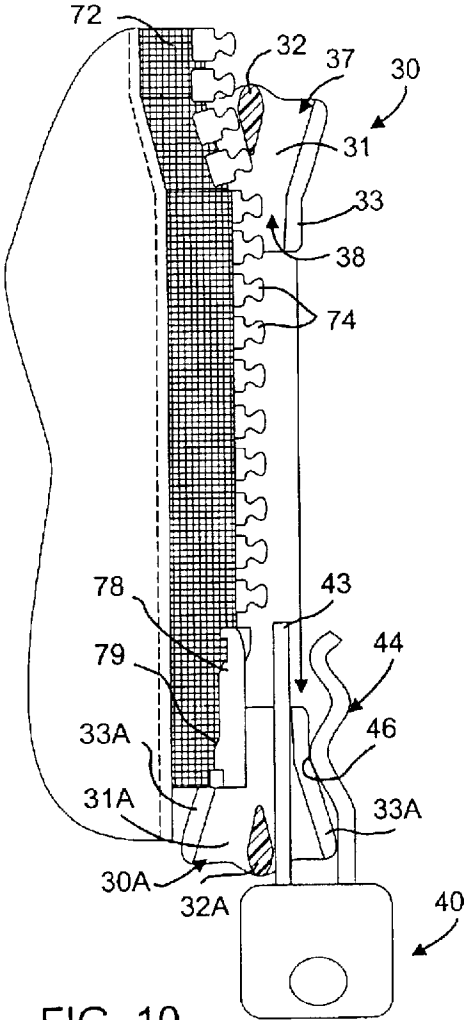
FIG. 10 is a view similar to FIG. 1, illustrating operation of the facilitating device thereof with a dual-slider zipper.

Referring now to FIGS. 10–12, there is illustrated a slide fastener, generally designated by the numeral 70, which is similar to the slide fastener 11, described above, but is provided with two sliders for double-ended opening of the fastener. The slide fastener 70 includes two stringers 72 and 73, respectively provided with rows of interlocking elements or teeth 74 and 75, the row of teeth 75 terminating in an elongated lug 76. The row of teeth 74 terminates in a stop member 78, which has a widened stop portion 79 at the distal end thereof.

The slide fastener 70 includes a slider 30 is substantially identical to that disclosed above in connection with FIGS. 1–4, whereby the same reference numerals will be used as were used with respect to those figures, and also includes a second slider 30A which may be substantially identical to the slider 30, but is arranged in reverse orientation, with its narrow end pointing upwardly toward the narrow end of the slider 30. The parts of the slider 30A will be designated with the same reference numerals as were used for like parts of the slider 30, but with the suffix "A".

In normal operation, in order to close the slide fastener 70, the slider 30A is first slid down to a terminal position, wherein one of the flanges 33A thereof engages the stop portion 79 of the stop member 78, as illustrated in FIG. 10. Then the slider 30 is slid downwardly into abutting relationship with the slider 30A. The two sliders 30 and 30A then are manually held in this position while the lug 76 is inserted downwardly through the arm portion 37 and stem portion 38 of the channel of the slider 30, and then into the stem portion 38A of the slider 30A, moving the lug 76 substantially into abutting relationship with the stop member 78. The slider 30 may then be slit upwardly away from the slider 30A, drawing the rows of teeth 74 and 75 sequentially into interlocking engagement with each other, all in a known manner. This process, and particularly manually holding the sliders 30 and 30A together in the terminal position of the slider 30A requires a degree of manual dexterity which may be difficult or nearly impossible for certain persons, such as those suffering from arthritis or the like.

The facilitating device 40 may be used to alleviate this situation. In operation, the distal end of the post 43 is inserted upwardly through the arm 36A of the channel of the slider 30A while the slider 30A is in its terminal position illustrated in FIG. 10, and either before or after the slider 30 has been moved into abutting relationship with the slider 30A. As can be seen in FIG. 11, the flanges 33A and 33 of the sliders 30A and 30 are resiliently gripped between the post 43 and the grip arm 44 of the facilitating device 40, with the crest 46 engaging the flange 33A of the slider 30A and the crest 45 engaging the flange 33 of the slider 30, as can be seen in FIG. 11.

The facilitating device 40 may then either be released or the user may continue to hold it while the lug 76 is inserted downwardly through the apertures in the sliders 30 and 30A, the lug 76 engaging the post 43 and displacing it from the apertures as the lug 76 is inserted.

After the lug 76 has been fully inserted in the sliders 30 and 30A, the slider 30 may be pulled upwardly to close the slide fastener 70 in the usual manner. Once the slide fastener 11 has thus been closed, it may be opened from either end, either by pulling the slider 30 back downwardly toward the stop member 78 or pulling the slider 30A upwardly away from the stop member 78, all in a known manner.

It will be appreciated that the facilitating devices 50 and 60 may also be used with the dual-slider slide fastener 70, with appropriate changes in the lengths of the arch 52 of the device 50 and the post 61 and grip arm 63 of the device 60.

While several specific sizes and shapes of facilitating devices have been described above, it will be appreciated that other sizes and shapes could be provided. Furthermore, while the disclosed devices utilize different forms of frictional engagement with the associated slide fastener, it will be appreciated that it would be possible to utilize other types of engagement. For example, in the case of metal slide fasteners, the facilitating device might be magnetically attachable to the slider and stop member of the slide fastener.

From the foregoing, it can be seen that there has been provided a simple and inexpensive device which can be easily manipulated, even by a person with impaired manual dexterity, to hold a zipper slider 30 in its terminal position against the stop member during insertion of the lug, greatly facilitating operation of the zipper.

The matter set forth in the foregoing description and accompanying drawings is offered by way of illustration only and not as a limitation. While particular embodiments have been shown and described, it will be apparent to those skilled in the art that changes and modifications may be made without departing from the broader aspects of applicant's contribution. The actual scope of the protection sought is intended to be defined in the following claims when viewed in their proper perspective based on the prior art.

What is claimed is:

1. A device for facilitating operation of a separable slide fastener having a pair of stringers respectively carrying first and second rows of interlocking elements, first and second members respectively having first and second apertures therein, at least one of the first and second members being slidable along the first row and disposable in a terminal position against another of the first and second members with the second aperture aligned with the first aperture, wherein the second row terminates in a lug receivable in the aligned apertures when the at least one member is in the terminal position to permit interlocking of the rows of elements by movement of the at least one member therealong, the device comprising:

a handle adapted to be easily grasped by a user; and retention structure coupled to the handle and engageable with the first and second members in a retaining position for holding the at least one member in its terminal position, the retention structure being displaceable from its retaining position during insertion of the lug into the aligned apertures.

2. The device of claim 1, wherein the retention structure is flexible and resilient.

3. The device of claim 1, wherein the retention structure is of unitary one-piece construction.

4. The device of claim 3, wherein the retention structure is engageable with outer surfaces of the first and second members.

5. The device of claim 4, wherein the retention structure includes portions which cooperate to clamp therebetween portions of the first and second members.

6. The device of claim 3, wherein the retention structure is engageable with inner surfaces of the first and second members.

7. The device of claim 6, wherein the retention structure includes a resilient arch which is compressible to permit insertion into the apertures.

8. The device of claim 1, wherein the retention structure is formed of metal.

9. The device of claim 1, wherein the retention structure is formed of plastic.

10. The device of claim 1; and further comprising attachment structure for coupling the device to a portion of the at least one member to prevent misplacement of the device when not in use.

11. The device of claim 1, wherein the retention structure is unitary with the handle.

12. The device of claim 1, wherein the first member is a stop member which terminates the first row of interlocking elements.

13. The device of claim 1, wherein each of the first and second members is slidable along the first row.

14. A method of facilitating operation of a separable slide fastener having a pair of stringers respectively carrying first and second rows of interlocking elements, first and second members respectively having first and second apertures therein, at least one of the first and second members being slidable along the first row and disposable in a terminal position against another of the first and second members with the second aperture aligned with the first aperture, wherein the second row terminates in a lug receivable in the aligned apertures when the at least one member is in the terminal position to permit interlocking of the rows of elements by movement of the at least one member therealong, the method comprising:

providing a device including a handle and retention structure, inserting the retention structure into the apertures to a retaining position when the at least one member is in or is moved to its terminal position, during the inserting, engaging the retention structure with the first and second members for holding the at least one member in its terminal position, and then inserting the lug into the apertures for displacing the retention structure from its retaining position.

15. The method of claim 14, wherein the engaging includes engaging the retention structure with inner surfaces of the first and second members.

16. The method of claim 15, wherein the retention structure includes a flexible and resilient arch, the inserting including compressing the arch to permit insertion of the retention structure into the apertures, the engaging resulting from resilient expansion of the arch toward an initial rest condition.

17. The method of claim 14, wherein the engaging includes engaging the retention structure with outer surfaces of the first and second members.

18. The method of claim 17, wherein the retention structure is flexible and resilient, the engaging including clamping portions of the first and second members between portions of the retention structure.

19. The method of claim 14, wherein the first member is a stop member which terminates the first row of interlocking elements.

20. The method of claim 14, wherein each of the first and second members is slidable along the first row.

* * * * *